US008684078B2

(12) United States Patent
Boyles et al.

(10) Patent No.: US 8,684,078 B2
(45) Date of Patent: Apr. 1, 2014

(54) SYSTEM AND METHOD FOR CONTROLLING FLUID PUMPS TO ACHIEVE DESIRED LEVELS

(75) Inventors: Greg Boyles, Houston, TX (US); Bob Snyder, Houston, TX (US)

(73) Assignee: Direct Drivehead, Inc., Houston, TX (US)

( * ) Notice: Subject to any disclaimer, the term of this patent is extended or adjusted under 35 U.S.C. 154(b) by 151 days.

(21) Appl. No.: 13/227,632

(22) Filed: Sep. 8, 2011

(65) Prior Publication Data

US 2013/0133881 A1 May 30, 2013

Related U.S. Application Data

(60) Provisional application No. 61/380,743, filed on Sep. 8, 2010.

(51) Int. Cl.
*E21B 43/12* (2006.01)

(52) U.S. Cl.
USPC ..... 166/250.15; 166/66; 166/105; 166/113; 700/281

(58) Field of Classification Search
USPC ..... 166/250.15, 113, 60, 61, 105, 62, 66; 700/1, 28, 78, 82, 87, 281, 282, 296
See application file for complete search history.

(56) References Cited

U.S. PATENT DOCUMENTS

| | | | |
|---|---|---|---|
| 3,936,231 | A | 2/1976 | Douglas |
| 3,938,910 | A | 2/1976 | Douglas |
| 3,972,648 | A | 8/1976 | Sangster |
| 4,076,458 | A | 2/1978 | Jones |

(Continued)

FOREIGN PATENT DOCUMENTS

| | | | |
|---|---|---|---|
| WO | 0236936 | A1 | 5/2002 |
| WO | WO0236936 | A1 | 5/2002 |
| WO | 2009005876 | A2 | 1/2009 |
| WO | 2009009196 | A2 | 1/2009 |

OTHER PUBLICATIONS

International Search Authority, International Application No. PCT/US11/50770, International Search Report and the Written Opinion, Jan. 6, 2012.

(Continued)

*Primary Examiner* — Giovanna Wright
*Assistant Examiner* — Ronald Runyan
(74) *Attorney, Agent, or Firm* — John A. Thomas

(57) ABSTRACT

A system for attaining and maintaining a pre-determined fluid level in a petroleum-producing well having a pump, such as a progressive-cavity pump, and a pump motor having a variable-frequency drive control using two sensors: a pump pressure sensor located at the pump depth and a casing pressure sensor located at the casinghead of the well. A programmable computer is connected to the first and second pressure sensors and the motor speed control so that the programmable computer controls the operation of the pump motor to attain and maintain a target fluid level in the well over a predetermined time interval for reaching the target fluid level in the well. The programmable computer computes an error signal to control a variable frequency drive motor, where the error signal is computed periodically from the difference between in the actual fluid level in the well and the target fluid level in the well according to a rate reference curve. In general, the rate reference curve is generated according to an exponential or hyperbolic function.

13 Claims, 5 Drawing Sheets

(56) References Cited

U.S. PATENT DOCUMENTS

| | | | | | |
|---|---|---|---|---|---|
| 4,102,394 | A | | 7/1978 | Botts | |
| 4,125,163 | A | * | 11/1978 | Fitzpatrick | 166/250.03 |
| 4,316,702 | A | | 2/1982 | Kiowski et al. | |
| 4,390,321 | A | | 6/1983 | Langlois et al. | |
| 4,490,094 | A | | 12/1984 | Gibbs | |
| 4,493,613 | A | | 1/1985 | Sommer | |
| 4,516,911 | A | | 5/1985 | Senghaas et al. | |
| 4,767,280 | A | | 8/1988 | Markuson et al. | |
| 4,971,522 | A | | 11/1990 | Butlin | |
| 5,251,696 | A | | 10/1993 | Boone et al. | |
| 5,462,114 | A | | 10/1995 | Catanese, Jr. | |
| 5,525,040 | A | | 6/1996 | Andreae et al. | |
| 6,041,856 | A | | 3/2000 | Thrasher et al. | |
| 6,325,142 | B1 | | 12/2001 | Bosley et al. | |
| 6,370,448 | B1 | * | 4/2002 | Eryurek | 700/282 |
| 7,044,714 | B2 | | 5/2006 | Bevan et al. | |
| 7,600,563 | B2 | | 10/2009 | Brecheisen | |
| 2002/0074127 | A1 | | 6/2002 | Birckhead et al. | |
| 2008/0067116 | A1 | * | 3/2008 | Anderson et al. | 210/100 |
| 2009/0100882 | A1 | * | 4/2009 | Bae et al. | 68/5 C |

OTHER PUBLICATIONS

International Beureau of WIPO, International Application No. PCT/US2011/050770, International Preliminary Report on Patentability, Mar. 21, 2013.

* cited by examiner

SYSTEM AND METHOD FOR CONTROLLING FLUID PUMPS TO ACHIEVE DESIRED LEVELS

CLAIM FOR PRIORITY

This application claims the priority of U.S. Provisional Patent Application, filed Sep. 8, 2010, under Ser. No. 61/380,743, and titled "System And Method For Controlling Fluid Pumps To Achieve Desired Levels," which application is incorporated by reference into the present application.

BACKGROUND

1. Technical Field

This disclosure relates generally to an automated process and method to control pump motor speed over time to cause the actual fluid level in a vessel or well bore to track a computer generated fluid level curve over time to a selected target fluid level above the pump, and to maintain that level over time regardless of varying conditions that may result from reservoir depletion, pump wear conditions, and or other fluctuations such as fluid rate entering a vessel.

2. Background

Methods of pumping fluid from vessels or wellbores have and continue to evolve. Pump protection methods and automation for pump operations exist and continue to improve.

Operators of these systems have encountered a common experience that destroys the artificial lift system namely, dry pumping (also called "pumping off"). Many have attempted ways to intuitively determine ways to protect the pumping equipment creating pump-off control devices that use a PLC (Programmable Logic Controller) with sensors to stop the pump when it is observed that there is no fluid flow at the surface or coming to or from the pump.

Operators use many monitors to help with dry pumping protection such as flow rate meters at the surface which are used to compare against expected flow rates, or electric motor operating parameters such as amperage load and capacitance of fluid, as well as other mechanical observations such as vibration and pounding that leads to damage of operational equipment. Through all these monitoring methods, the idea is to protect the pump if the estimate of flow rate is incorrect and ultimately stop the pump when the pump runs out of fluid to pump.

Prior art (pump off control or intuitive speed control) systems require time consuming step ladder programming in setting up a standard PLC to establish operational parameters and then set limits which as time passes, require further human intervention to "tune" the operation as the operator determines over time that the speed of operation they select to pump at desired rates was an incorrect guess.

Other art specific to electric submersibles and or progressive cavity pumps seek to enhance or maximize production. This automation is based on estimating an expected fluid flow rate and comparing the expected to the actual flow rate to determine pump speed. This is simply pumping faster to get more fluid flow.

What is needed is a pump control system that does not need to know pump output potential at a given speed in order to perform its given task and does not have to take into account pump flow design rates. Also, such a system should be able to control all forms of artificial lift systems that employ an electric motor as the prime mover of the pump.

Preferably, such a system should require no human effort once the operator provides two inputs: desired fluid level target and the time or number of days they wish the processor to achieve the target. After defined, no additional input should be required, regardless of changing reservoir and pump conditions over time; the system should continuously calculate and provide speed control commands to offset changing conditions.

DRAWINGS

DESCRIPTION

The system disclosed automatically determines the fluid level in a vessel or wellbore by establishing a fluid level reference curve to a desired ultimate target level, over time, for automated real time motor speed commands that cause the actual fluid level to track the computer-generated reference curve to the target level over time. The system continuously compares the actual fluid level to the computer generated reference curve to target level to determine motor speed commands to either remain constant, increase, decrease or stop (if needed), based on where the actual level is in relationship to the computer generated reference level to target.

Therefore the system does not attempt to set a desired pump output flow rate and compare that information to the actual rate to make operational decisions when the first rate does not match the second. Rather, the system is designed to automatically discover the productivity capability of the well over time without human involvement by commanding the pump motor to various pumping speeds based on an algorithm that in effect matches capability or inflow to pump speed output to cause the extraction rate to match the specific inflow and ultimately determine the optimum speed to maintain a targeted fluid level.

Figure 1:
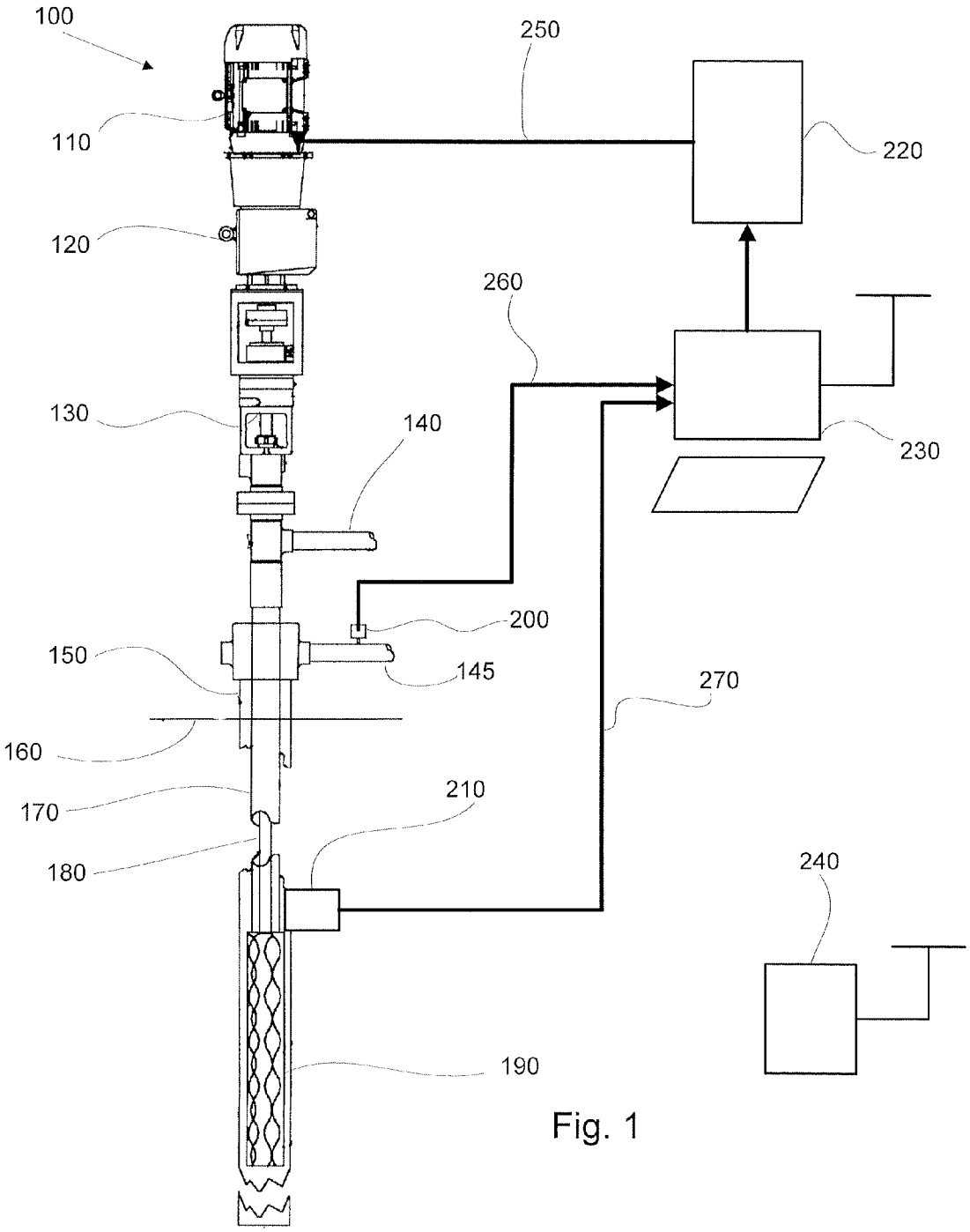
FIG. 1 shows typical well with a progressive-cavity pump downhole and the disclosed control elements.

FIG. 1 shows an exemplary petroleum-producing well (100) having a progressive-cavity pump, although the reader should understand that the embodiments disclosed here are capable of operation with any motor-controlled pump, such as down-hole pumps operated by pump jacks, or with other wells, such as water wells. Also, the system could be used to maintain a fluid level in some vessel having an inflow.

In FIG. 1, a variable-frequency motor (110) drives a gearbox (120) that couples to a rotating driveshaft (130). The drive shaft proceeds through the well casing (150) and tubing (170) below grade (160) to rotate a string of rods (180) that rotate the progressive-cavity pump (190) near the bottom of the well. The well has a flow line (140) for produced oil and a second flow line (145) for produced gas.

FIG. 1 shows a variable-frequency drive (220), or VFD, connected to the motor (110) via power line (250), a first pressure sensor (200) that monitors casinghead pressure, and a second pressure sensor (210) that monitors fluid pressure at the pump depth. Such VFD's and pressure transducers are known in the art. The VFD (220) and the first and second pressure sensors (200, 210) are operatively connected via communication lines (260, 270) to a programmed digital computer (230), which computer (230) may be a microprocessor with input-output facilities and a memory. Optionally, the computer (230) may be connected to the VFD (220) and first and second pressure sensors (200, 210) by a communications link (240) for remote operation, such as through the Internet.

Figure 2:
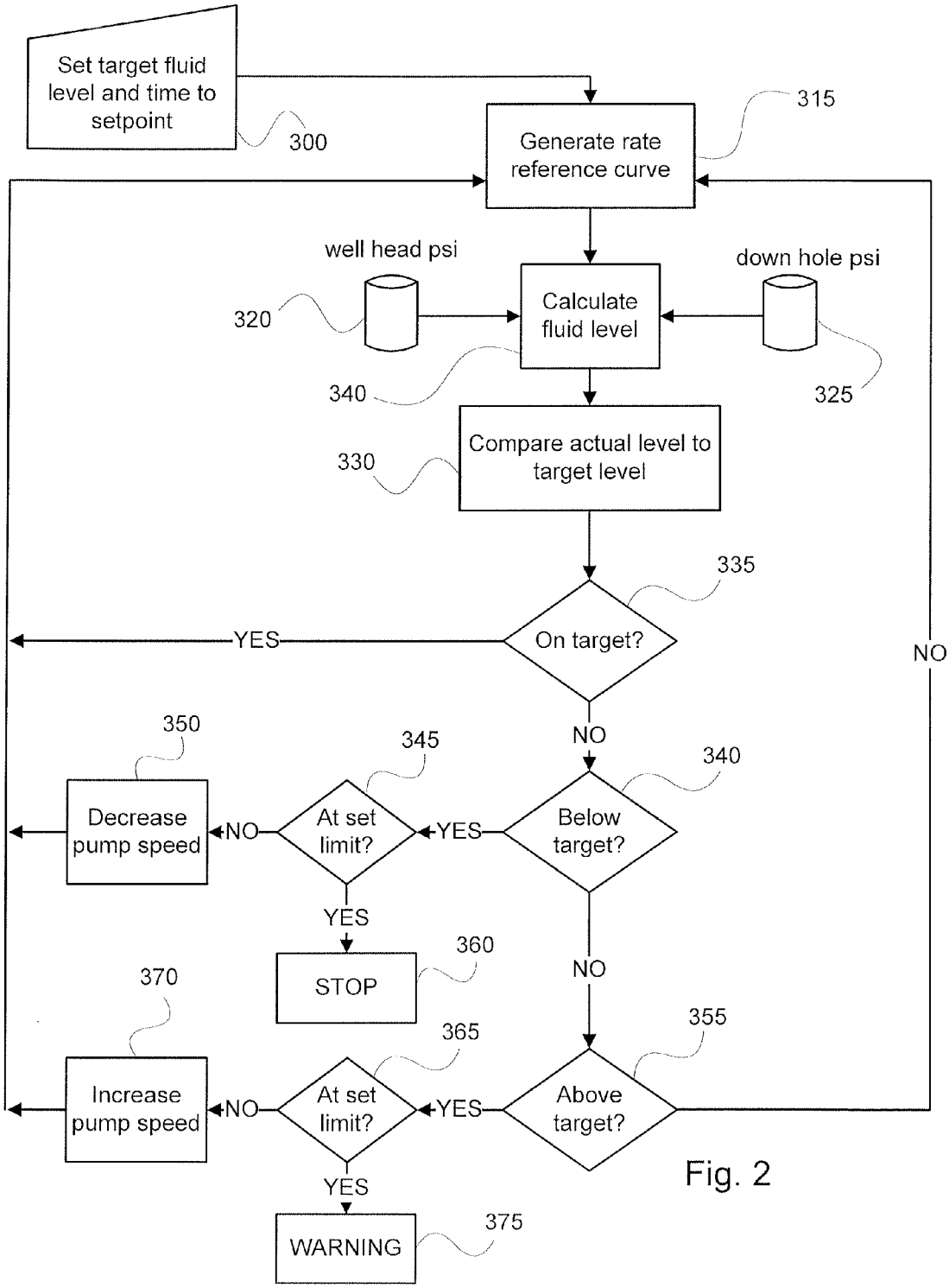
FIG. 2 is a flow chart describing a method for an exemplary embodiment.

FIG. 2 is a flow chart depicting the overall control loop executed by the computer in the preferred embodiment. At step 300, the operator initializes at least two variables; the target fluid level desired in the well, and the time (usually in days of pumping) to reach this target fluid level. At step 315, the computer generates a rate reference curve to reach the target level in the specified time; the details of step 315 are taken up below and in FIG. 3. In general, the curve generated will command an exponential or hyperbolic decline in motor speed.

At step 340, the computer calculates the actual fluid level in the well from inputs from the casinghead pressure sensor (200) and the downhole pressure sensor (210). The fluid pressure on the pump will be the downhole pressure minus the casinghead pressure. As will be discussed below, the preferred embodiment actually calculates the reference curve in terms of pressure, which is converted to a fluid level in the well. FIG. 2 refers to this as calculating the fluid level, although the preferred embodiment does not do so directly, but rather calculates a pressure.

Step 330 compares the actual level found to the target level and generates an error signal. If the level is on target for the current time interval, control passes to step 315 for updating of the reference curve for the next time interval. If the fluid level is not on target, control passes to step 340. If the fluid level is below the target level, step 345 checks to see if the fluid level has dropped to at or below the operator set limit, generally the depth of the pump in the wellbore. If so, step 360 stops the pump; if not step 350 commands a decrease in pump speed.

Continuing with the flow chart in FIG. 2, if the fluid level is not below the target, step 355 checks to see if the level is above the target. If not, control returns to step 315; else, the fluid level is checked against the upper set limit at step 365. If the fluid level is above the upper set limit, the system sends a warning in step 375; else, the system commands an increase in pump speed at step 370, from where control returns to step 315.

Figure 3:
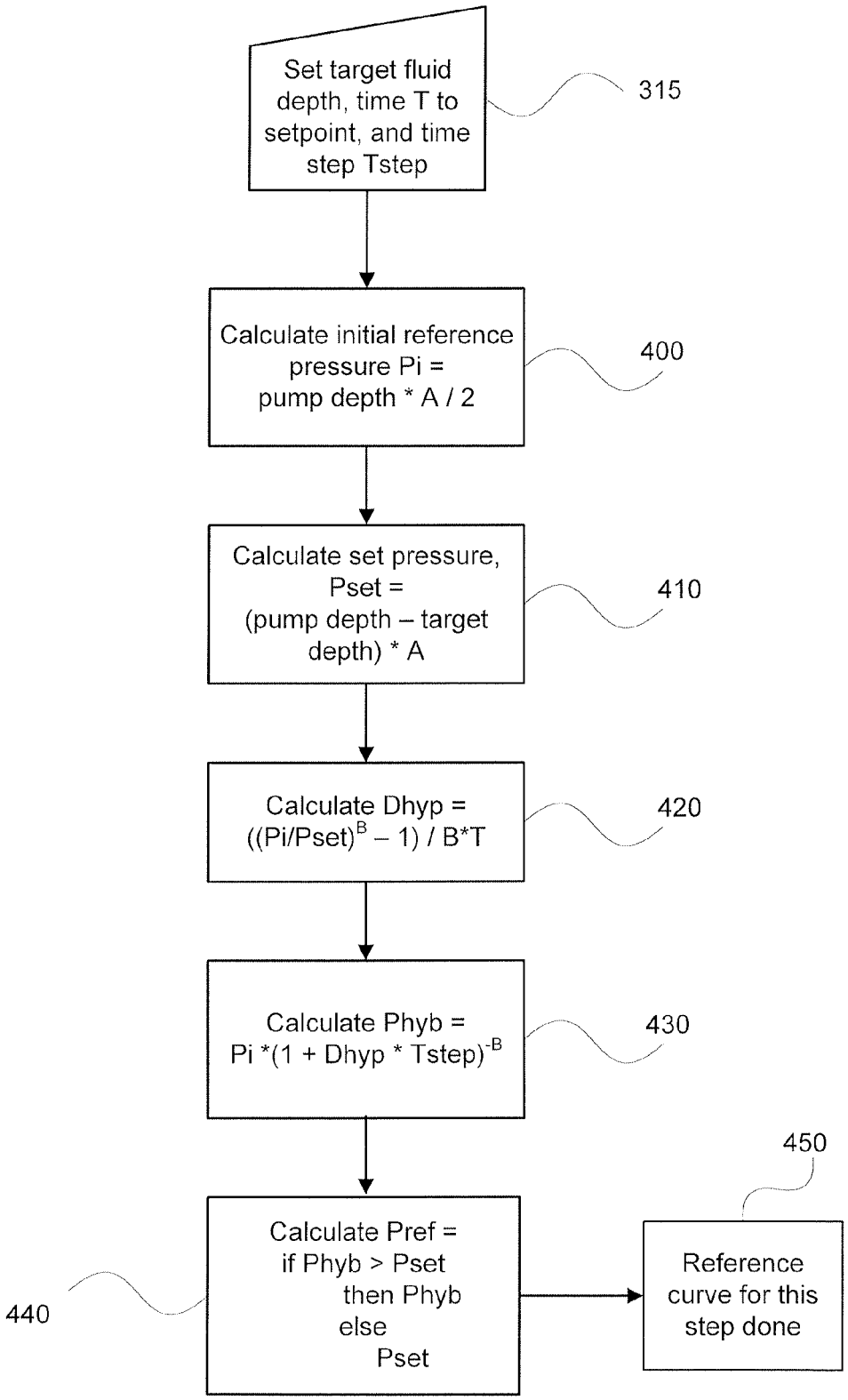
FIG. 3 is a flow chart describing an exemplary calculation of a rate of pumping curve.

The rate reference curve in the illustrated embodiment is calculated each time the computer program executes step 315 as shown in FIG. 3. First the initial reference pressure is calculated in step 400. Then at step 410 the set pressure is calculated, taking into account the pump depth and the target depth for the fluid. Step 420 calculates an intermediate variable, Dhyp, that defines the exponential or hyperbolic decline curve. Dhyp is used in step 430 to calculate Pi, the initial reference pressure. Step 440 calculates the rate curve reference pressure, Phyb, for comparison to the target level.

In FIG. 3, the value of variable "A" in step 400 is conveniently taken as 0.45, for typical wellbore fluids. This value may be changed by the operator to more nearly match actual well conditions. The value "B" in steps 420 and 430 is conveniently take to be 0.7. This exponent may also be adjusted by the operator, but has been found to be satisfactory for typical well conditions.

Figure 4:
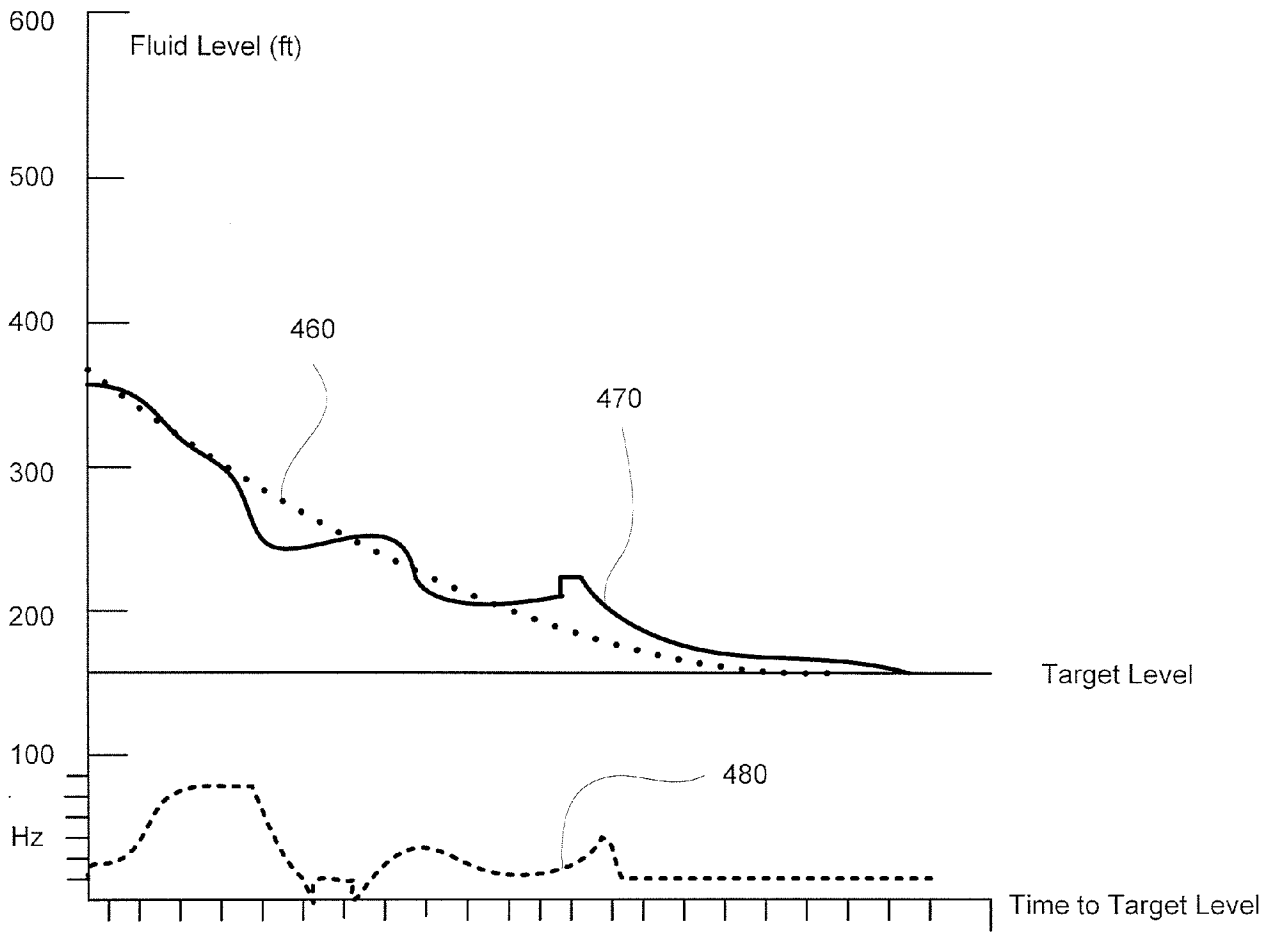
FIG. 4 is an exemplary graph shown typical operation of the system to achieve a steady fluid level.

FIG. 4 is an exemplary graph of a generated rate reference curve (460) being compared to the actual fluid level (470). The resulting error signal then is used to generate commands to the pump motor VFD with the graphed changes in motor Hz (480) as shown. The reader should note that FIG. 4 is for illustration only, and the exact shape of the fluid level curve (470) and the motor Hz curve (480) will be different for different well situations. The important point, is the actual fluid level curve (470) declines over the target time period to converge to the rate reference curve (460).

The process is thus not an on-off duty cycle process but rather a process that hunts for an optimum pump speed for continuous duty operation that maintains a selected target level. Thereafter, as conditions change, such as an increase or decrease in fluid entering the well, the process will speed up the pump or slow it down to match the condition to keep the desired fluid level target, which can be changed manually or remotely. In addition, the system will speed the pump up automatically over time as the pump efficiency diminishes from wear in order to maintain the targeted fluid or hydrostatic level. The system may also log pump speed versus volume output over time which serves as a pump wear diagnostic tool.

The system and process can be used to control any type of artificial lift system; pump jacks, drive heads, electric submersible and others by using only two input sensors; a down hole pressure sensor at the pump in fluid and a surface casing pressure sensor, to calculate and determine the fluid level within a wellbore or vessel, and two user input values: the desired ultimate fluid level, and the time length of time a user wants for the system to reach the target level.

Figure 5:
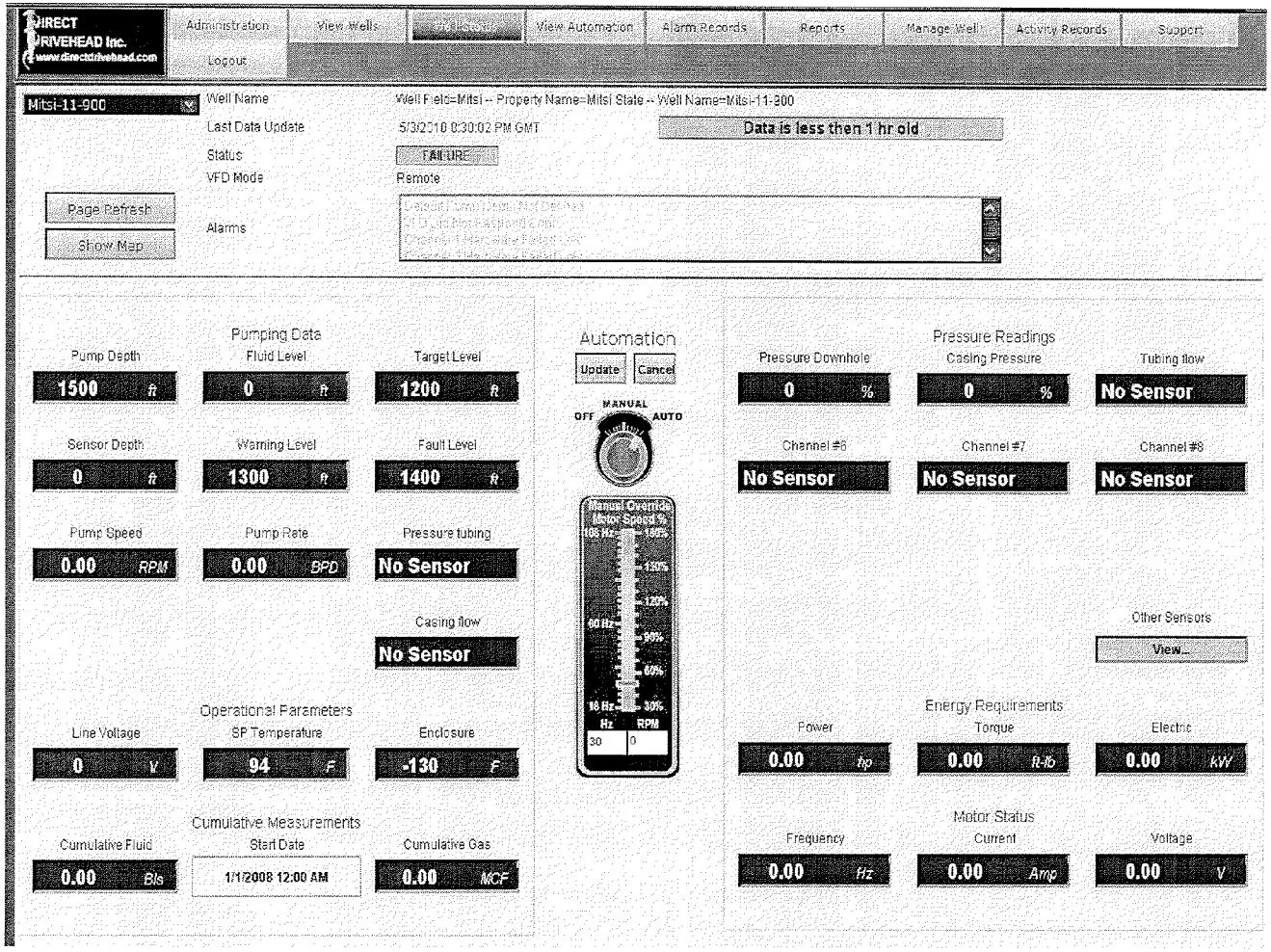
FIG. 5 is an exemplary user interface.

FIG. 5 shows an exemplary user control interface for such a programmed computer.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

We claim:

1. In a well having a pump and a pump motor having a motor speed control, a system for attaining and maintaining a pre-determined fluid level in the well, the system comprising:

a second pressure sensor that monitors pump pressure located at the pump depth;

a first pressure sensor that monitors casing pressure located at the casing head of the well;

a programmable computer connected to the first and second pressure sensors and the motor speed control, where:

the programmable computer controls the speed of the pump motor to attain and maintain a target fluid level in the well over a predetermined time interval for reaching the target fluid level in the well; and, where the programmable computer computes an error signal proportional to fluid level to control a variable frequency drive motor, where the error signal proportional to fluid level is computed periodically from the difference between the actual fluid level in the well and the target fluid level in the well according to a rate reference curve; and, where the rate reference curve is generated according to an exponential function.

2. The system of claim 1 where the programmable computer is configured to receive data from the pump pressure sensor and the casing pressure sensor to calculate the fluid level within the well.

3. The system of claim 2 where the programmable computer is further configured to receive user inputs for the desired fluid level in the well and the predetermined time interval for reaching the target level in the well.

4. The system of claim 1 where the programmable computer provides a user interface for entering a target fluid level in the well.

5. The system of claim 1 where the programmable computer provides a user interface for entering the predetermined time interval for reaching the target fluid level in the well.

6. The system of claim 1, where the pump is a progressive-cavity pump.

7. The system of claim 1, where the pump is a pump jack lifting a submersible pump.

8. The system of claim 1 where the programmable computer is remotely controlled through an internet connection.

9. In a well having a pump and a pump motor having a motor speed control, a method for attaining and maintaining a pre-determined fluid level in the well, the method comprising:

measuring the pressure in the well at the pump depth;

measuring the pressure at the casinghead of the well;

setting a predetermined time interval for reaching a target fluid level in the well;

calculating the fluid level in the well from the pressure at the pump and the pressure at the casinghead of the well;

calculating a rate reference curve for the target fluid level in the well over the predetermined time interval;

computing an error signal proportional to fluid level from the difference between the actual fluid level in the well and the target fluid level in the well according to the rate reference curve;

using the error signal proportional to fluid level to control a variable-frequency drive motor driving the pump to attain and maintain the target fluid level in the well.

10. The method of claim 9, where the rate reference curve is generated according to an exponential function.

11. The method of claim 9, where the rate reference curve is calculated at predetermined time intervals.

12. The method of claim 9, where the error signal is computed at predetermined time intervals.

13. The method of claim 9 further comprising logging pump speed versus volume output over time to detect pump wear.

* * * * *